US008006863B2

(12) United States Patent
Albrecht

(10) Patent No.: US 8,006,863 B2
(45) Date of Patent: Aug. 30, 2011

(54) CONTAINER

(75) Inventor: David D. Albrecht, Le Mars, IA (US)

(73) Assignee: Wells Enterprises, Inc., Lemars, IA (US)

( * ) Notice: Subject to any disclaimer, the term of this patent is extended or adjusted under 35 U.S.C. 154(b) by 385 days.

(21) Appl. No.: 11/845,542

(22) Filed: Aug. 27, 2007

(65) Prior Publication Data

US 2008/0047960 A1 Feb. 28, 2008

Related U.S. Application Data

(60) Provisional application No. 60/823,610, filed on Aug. 25, 2006.

(51) Int. Cl.
*B65D 25/32* (2006.01)

(52) U.S. Cl. ..... 220/760; 220/773

(58) Field of Classification Search ..... 220/760, 220/773, 774, 805; D7/391
See application file for complete search history.

(56) References Cited

U.S. PATENT DOCUMENTS

| | | | | |
|---|---|---|---|---|
| 2,839,220 | A | 6/1958 | Carlin | |
| 3,384,263 | A | 5/1968 | Bernstein | |
| 3,424,342 | A | 1/1969 | Scopp et al. | |
| 3,688,942 | A | 9/1972 | Mitchell et al. | |
| 3,773,207 | A | 11/1973 | Dokoupil et al. | |
| 3,809,284 | A | 5/1974 | Churan | |
| 3,811,597 | A | 5/1974 | Frankenberg et al. | |
| 3,866,791 | A | 2/1975 | Roper et al. | |
| 4,376,493 | A | 3/1983 | Gall | |
| 4,941,586 | A | 7/1990 | Tarna | |
| 5,012,928 | A | 5/1991 | Proffitt et al. | |
| D318,015 | S * | 7/1991 | DeCoster et al. | D9/435 |
| 5,348,181 | A | 9/1994 | Smith et al. | |
| 5,425,467 | A | 6/1995 | Feer et al. | |
| 5,500,635 | A | 3/1996 | Mott | |
| 5,507,407 | A | 4/1996 | Feer et al. | |
| 5,538,154 | A | 7/1996 | Von Holdt | |
| 5,624,051 | A | 4/1997 | Ahern, Jr. et al. | |
| 5,626,251 | A * | 5/1997 | Luburic et al. | 220/276 |

(Continued)

FOREIGN PATENT DOCUMENTS

DE 200 10 982 U1 9/2000

(Continued)

OTHER PUBLICATIONS

Correspondence from Shimokaji & Associates dated Nov. 27, 2007 (47 pages).

*Primary Examiner* — Harry A Grosso
(74) *Attorney, Agent, or Firm* — McKee, Voorhees & Sease, P.L.C.

(57) ABSTRACT

The present invention is a square-shaped product container having a bail pivotally attached to an upper portion of opposite corners of the container. A mating lid for the container is formed which mates with a top portion of the container and has a tab which extends outward and downward from a sealing lip on the lid. The tab on the lid and the bail on the container work in conjunction when a user pulls downward on the bail and upward on the tab to easily pull the tab corner of the lid upward away from the container. Then, the remaining portion of the lid sealed to the container easily follows with forces upward on the lid and downward on the bail.

20 Claims, 10 Drawing Sheets

U.S. PATENT DOCUMENTS

| | | | | |
|---|---|---|---|---|
| 5,641,090 | A * | 6/1997 | Kowalski et al. | 220/782 |
| D401,110 | S | 11/1998 | Demore | |
| 5,960,979 | A | 10/1999 | Van Den Brink et al. | |
| 6,299,005 | B1 | 10/2001 | Higgins | |
| 6,834,772 | B1 | 12/2004 | Thorso | |
| 6,889,860 | B2 | 5/2005 | Mazzarolo | |
| 2002/0175173 | A1 * | 11/2002 | Diesterbeck | 220/782 |
| 2003/0197014 | A1 * | 10/2003 | Muchin et al. | 220/318 |

FOREIGN PATENT DOCUMENTS

| | | | |
|---|---|---|---|
| DE | 100 38 386 | A1 | 2/2002 |
| JP | 2000 302117 | A | 10/2000 |

* cited by examiner

CONTAINER

CROSS-REFERENCE TO RELATED APPLICATIONS

This application claims priority under 35 U.S.C. §119 to a provisional application Ser. No. 60/823,610 filed Aug. 25, 2006, which application is hereby incorporated by reference in its entirety.

BACKGROUND OF THE INVENTION

The present invention relates to an improved container. More specifically, the present invention relates to an easy-open square-shaped container which is easy to carry.

Generally, square containers are more efficient for storing products, such as food, because they stack closer together with less wasted space outside of the container between adjacent containers. Thus, it is desirable to use square containers in food products, such as ice cream, to utilize the most space within the freezer in store freezer cases. However, one problem with square containers is that it is generally difficult to get the lids off of the container. Thus, the user generally has to pull from a corner of the lid because pulling from the side of the lid simply pulls the adjacent corners closer together and makes it more difficult to remove the lid. Additionally with cold food products, such as ice cream, the containers are cold and possibly wet with condensation and slippery when the user tries to remove the lid. Thus, there is a need in the art for an improved container which has efficient use of storage space but is easy to open.

In view of the foregoing, a primary feature or advantage of the present invention is to provide an improved container.

Another feature or advantage of the present invention is to provide a container with a lid that is easy to grip and remove from the square container.

Another feature or advantage of the present invention is a container which is easy to carry and provide structure on both the container and lid for ease of opening a square lid on the square container.

Another feature or advantage of the present invention is a method of removing a square-shaped lid from a square-shaped container.

These and or other features or advantages of the present invention will become apparent from the specification and claims that follow.

BRIEF SUMMARY OF THE INVENTION

According to one aspect of the present invention, an improved container and lid combination is disclosed. The improved container and lid combination includes a container body having a base and sidewalls extending upward from the base to form the container, a bail pivotally attached to opposite corners of the container, and a lid body having a top and sides extending downward from the top to form the lid, wherein the lid is adapted to mate to the container. In the preferred form, the lid includes a tab which extends outward and downward from a corner portion of the lid whereby a user may pull downward on the bail and upward on the tab to lift the lid from the container, the container includes an ear on opposite corners having a slot adapted to pivotally secure the bail to the container, the bail has terminal ends with a pin extending perpendicularly inward there from being securable within the slot, the sidewalls terminate in a mouth opposite the base having a lip adapted to seat against a slot in the lid, inner sides of the lid have one or more ridges adapted to secure the lid to the lip of the container, the top of the lid has a recess adapted to receive the base of another container when one or more of the containers are stacked together, the lid also has a rim near the outer periphery, and the rim is adapted to secure sides of another lid when one or more lids are stacked together.

A new method for an improved container and lid combination is disclosed. The method includes taking the container having a base and sidewalls and the lid having a top and sides and removing the lid from the container by pushing downward against the container on a bail pivotally attached to opposite corners of the container while lifting upward on the lid. In the preferred form, the method also includes the step of inserting one or more fingers underneath a tab integrally formed in a corner of the lid for lifting up on the tab to remove the lid and the step of balancing forces exerted while removing the lid by pushing downward on the bail against the container and lifting upward on the tab at the same time.

BRIEF DESCRIPTION OF THE DRAWINGS

While the specification concludes with claims particularly pointing out and distinctly claiming the invention, it is believed that the present invention will be better understood from the following description taken in conjunction with the accompanying drawings in which:

DETAILED DESCRIPTION OF THE PREFERRED EMBODIMENT

Figure 1:
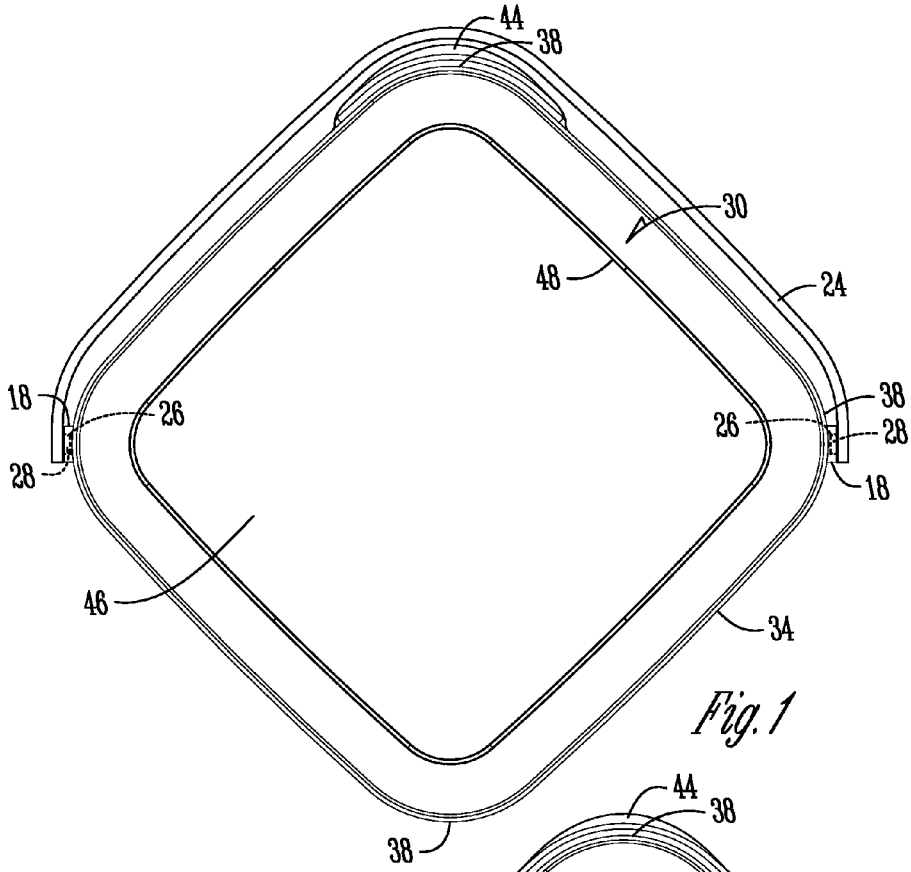
FIG. 1 shows a top view of one embodiment of the container with the lid in place showing a bail connected to ears on the container, and a tab on the lid.
Figure 2:
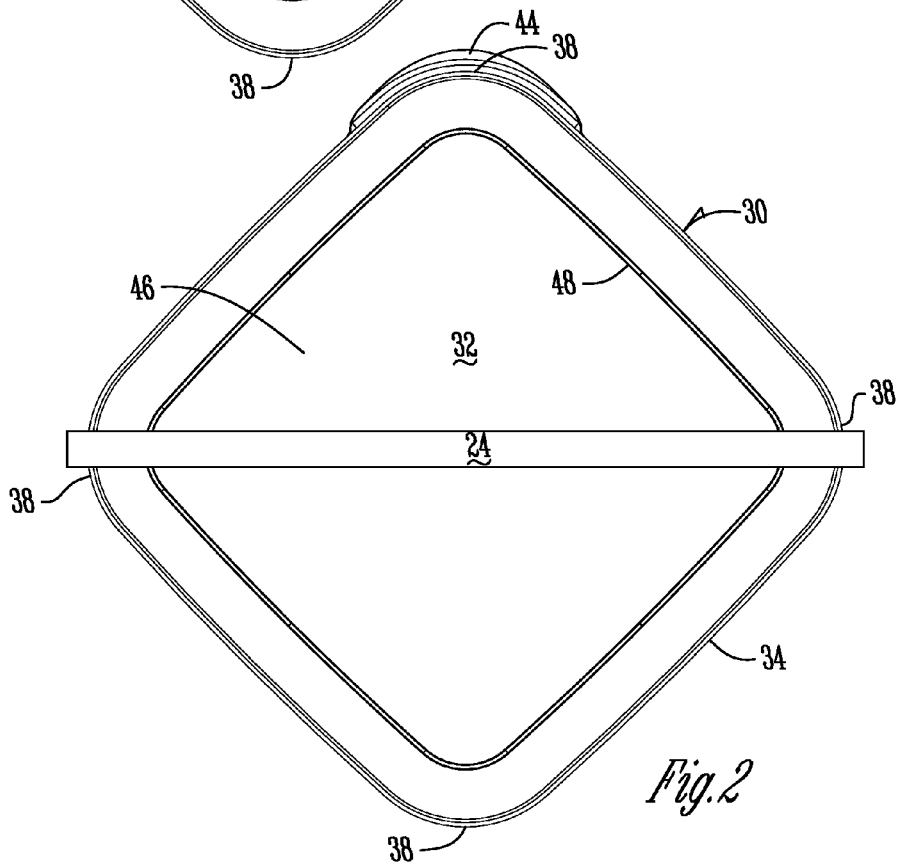
FIG. 2 shows the container of FIG. 1 with the bail positioned upward for carrying or moving the container.
Figure 3:
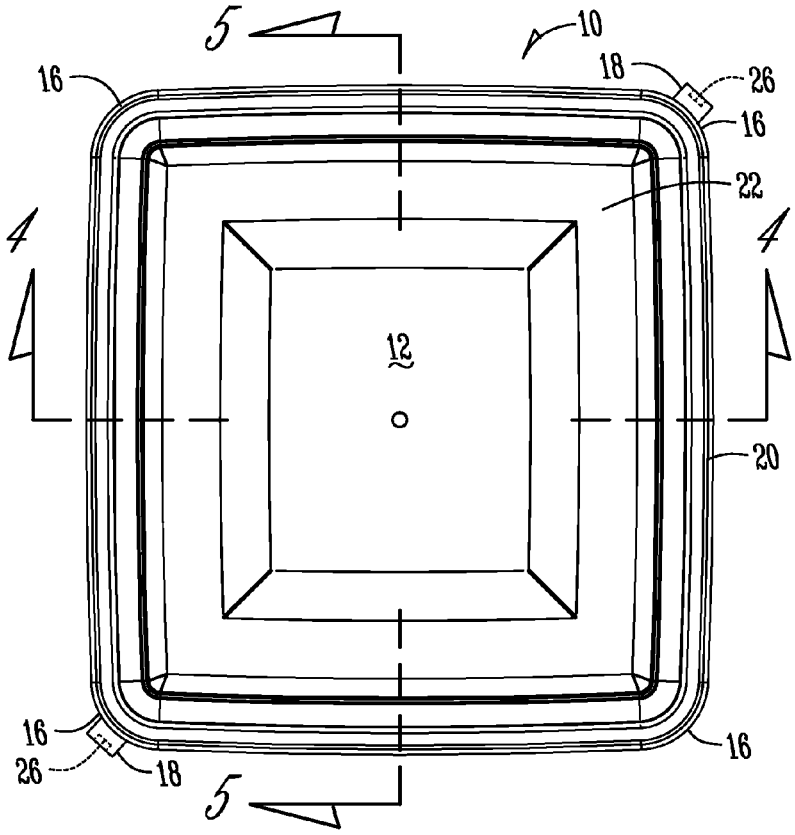
FIG. 3 is a plan view of the container without showing the bail attached.

FIGS. 1 and 2 show a top view of the container 10 and lid 30 combination of the present invention with the lid 30 situated in a sealed position on the mouth 22 of the container 10. FIG. 1 shows the bail 24 positioned down and along the corner 16 and two sidewalls 14 of the container 10. The bail 24 is connected to the container 10 by ears 18 located on opposite corners 16 of the container 10. The lid 30 locates on the container 10 so that a tab 44 on the lid 30 is on the corner 38 of the lid 30 which is not connected to the bail 24 so that as the user removes the lid 30, the user can pull downward on the bail 24 and place their fingers under the tab 44 to lift upward on the tab 44, creating opposite forces. Thus, the corner portion 38 of the lid easily lifts and thereby lifts the adjacent sides 36 of the lid 30. Once the corner of the lid 30 with the tab 44 is raised from the container 10 and the sides 36 adjacent the tab 44 are raised, the remaining portion of the lid 30 easily lifts off of the container 10.

Figure 11:
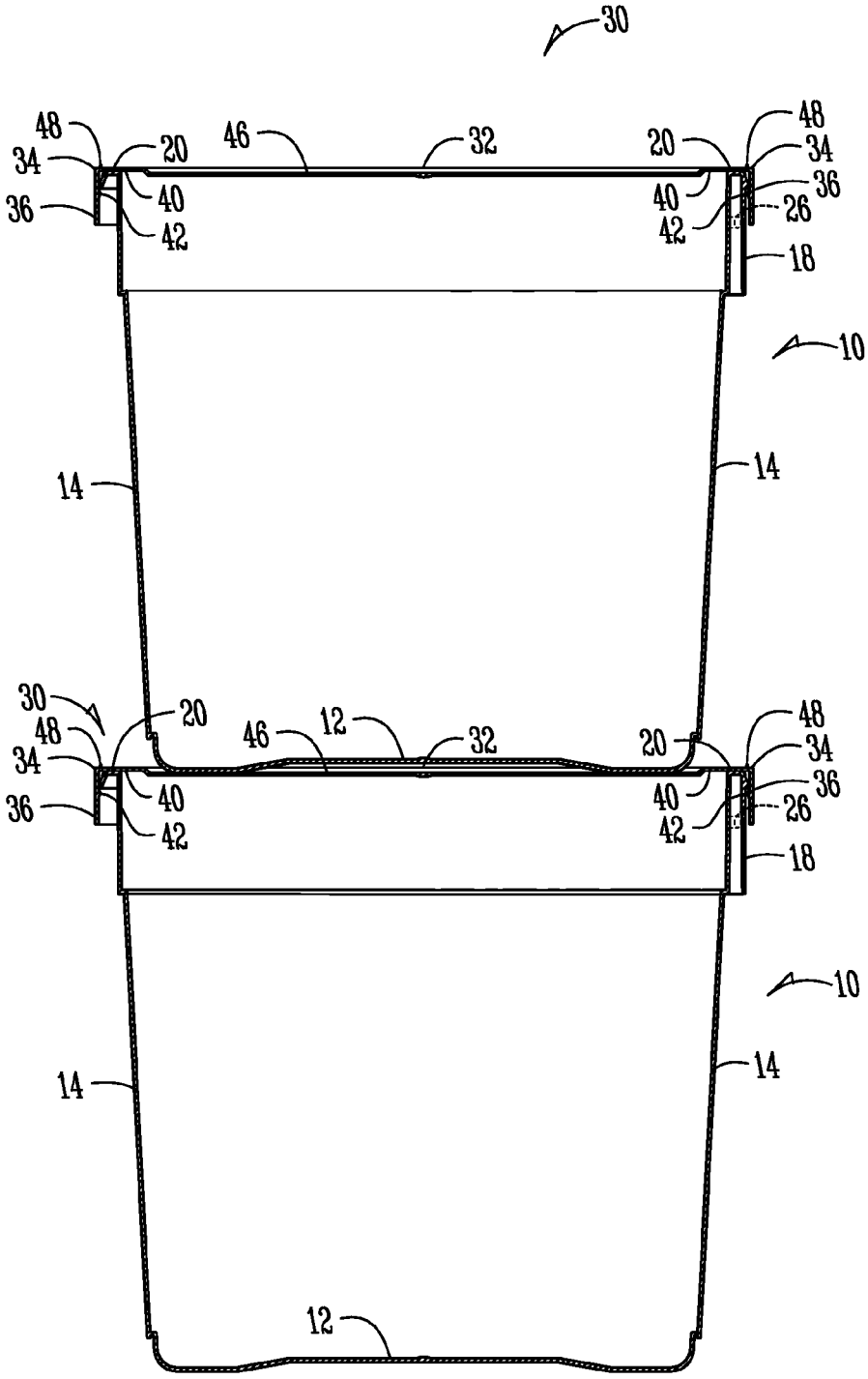
FIG. 11 is a side cross-sectional view of one lidded container stacked on top of another lidded container.
Figure 12:
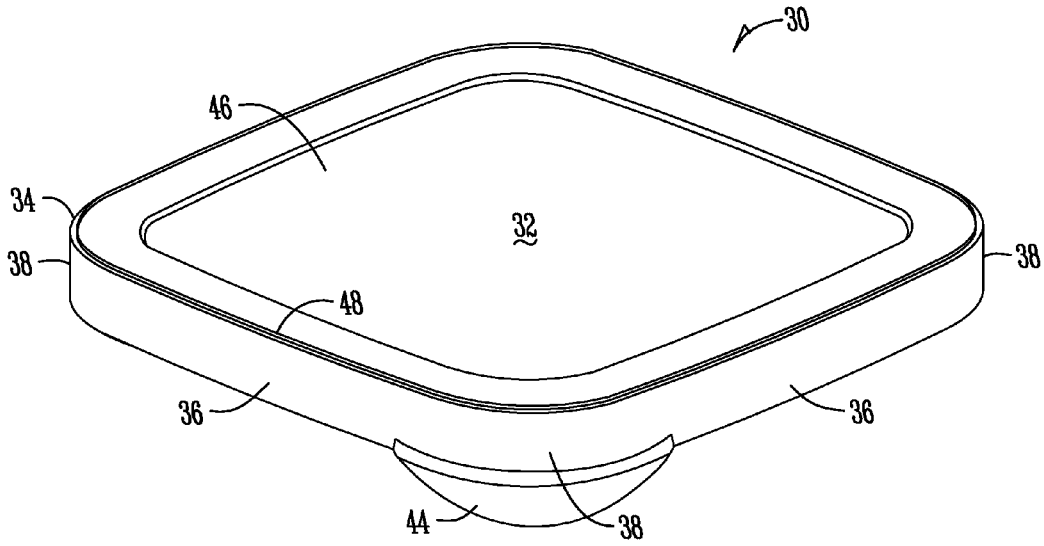
FIG. 12 is a top perspective view of the lid according to an exemplary embodiment of the present invention.
Figure 13:
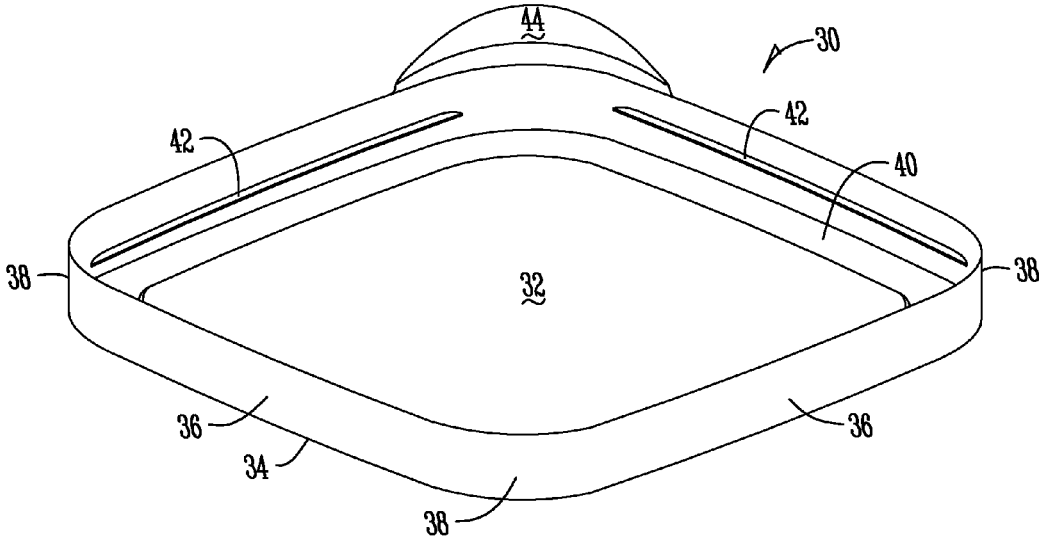
FIG. 13 is a bottom perspective view of the lid according to an exemplary embodiment of the present invention.
Figure 14:
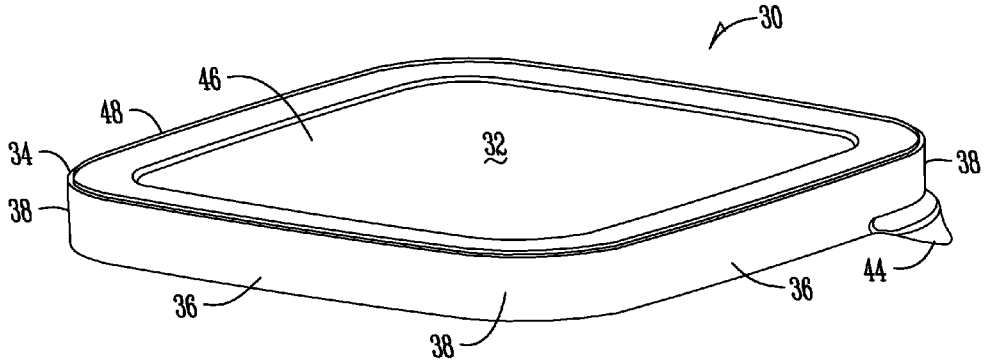
FIG. 14 is another top perspective view of the lid according to an exemplary embodiment of the present invention.
Figure 15:
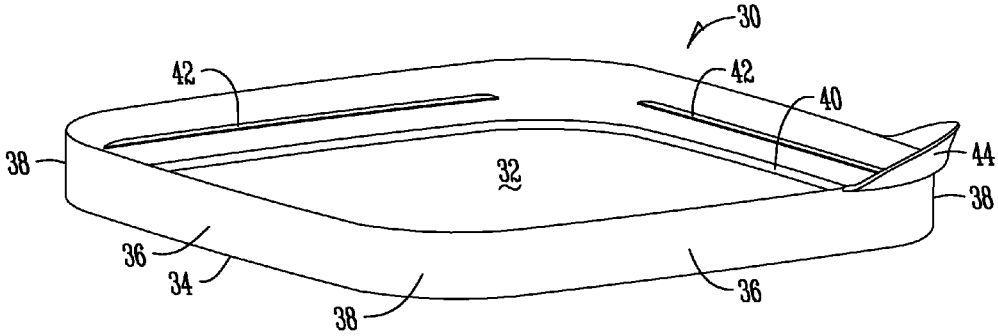
FIG. 15 is another bottom perspective view of the lid according to an exemplary embodiment of the present invention.
Figure 16:
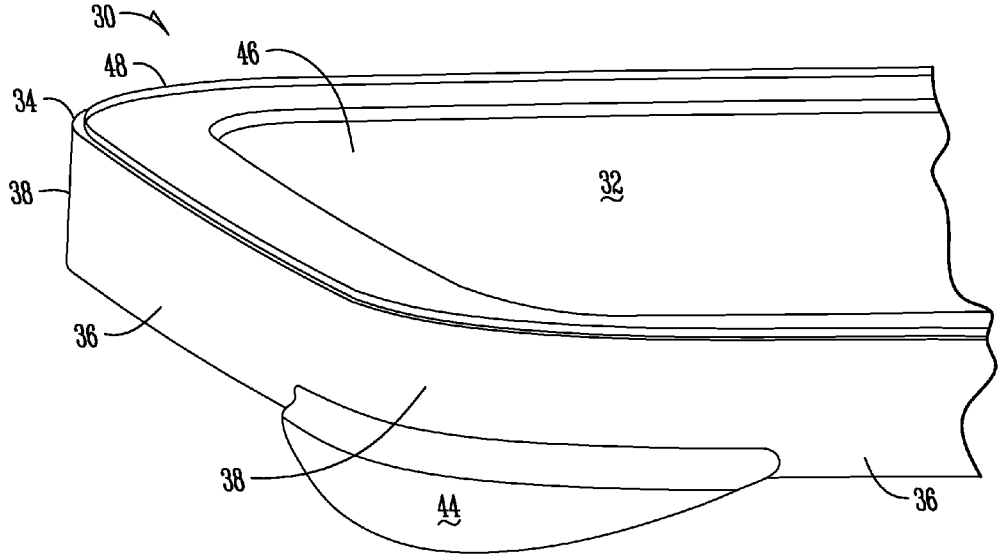
FIG. 16 is a perspective view of the tab according to an exemplary embodiment of the present invention.

FIG. 2 shows the bail 24 in an upright position, positioned over the lid 30. The bail 24 will be in this position during carrying of the container 10. In this way, a user can carry the container 10 by the bail and avoid getting their fingers cold if the container 10 holds cold products, such as ice cream. The bail 24 has the ability of pivoting in the ears 18 on the container 10 from one corner 16 of the container 10 over the top of the container 10 and down over the corner 16 on the other side of the container 10 until it rests against the corner 16 and two sidewalls 14 of the container 10. In this way, the bail 24 can be positioned out of the way when two or more containers 10 are stacked together as shown in FIG. 11. Additionally, the lid 30 may have more than one tab 44. For example, another tab (not shown) may be configured into the corner 38 opposite tab 44 in the lid 30 so that no matter which way the bail 24 is positioned down, the user can pull down on the bail 24 and have a tab 44 available for pulling upward to open the lid 30.

The bail 24 may affix to the container 10 by any type of connection which allows the bail 24 to pivot. One example is where the bail 24 has a tab or pin 28 extending inward which mates with a corresponding friction fit slot 26 in the ear 18 and the ear 18 is integrally connected to the container 10. The tab or pin 28 extending from the bail 24 fits in the slot 26 in the ear 18 yet pivots around the pin 28.

The container 10, lid 30, and bail 24, can be made from any material which is desired for the intended purpose. However, it is preferred that these items be formed from a plastic material. In addition, if the container assembly is to contain food, the plastic material should be food grade.

Figure 4:
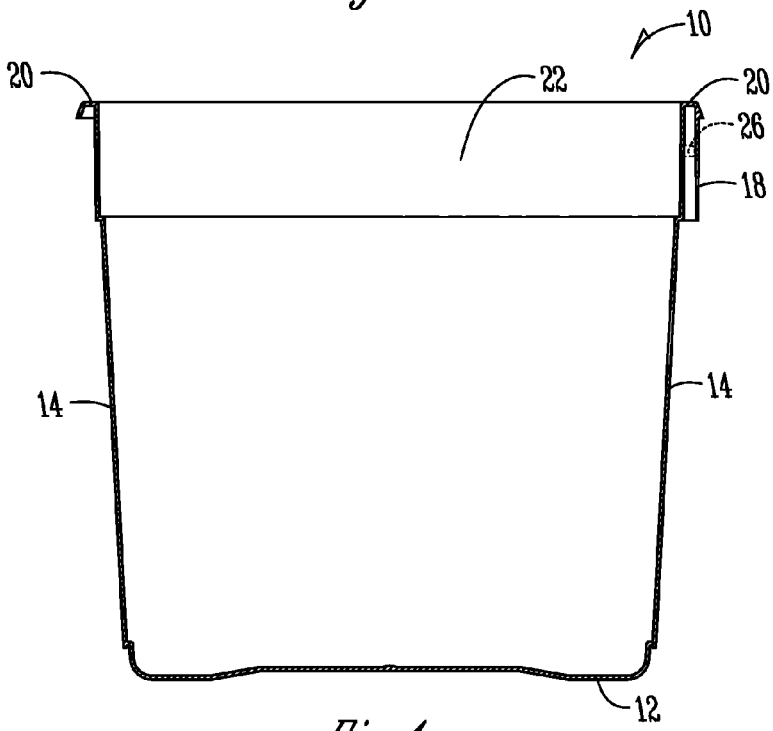
FIG. 4 is a cross-sectional view of the container taken along line 4-4 in FIG. 3.
Figure 5:
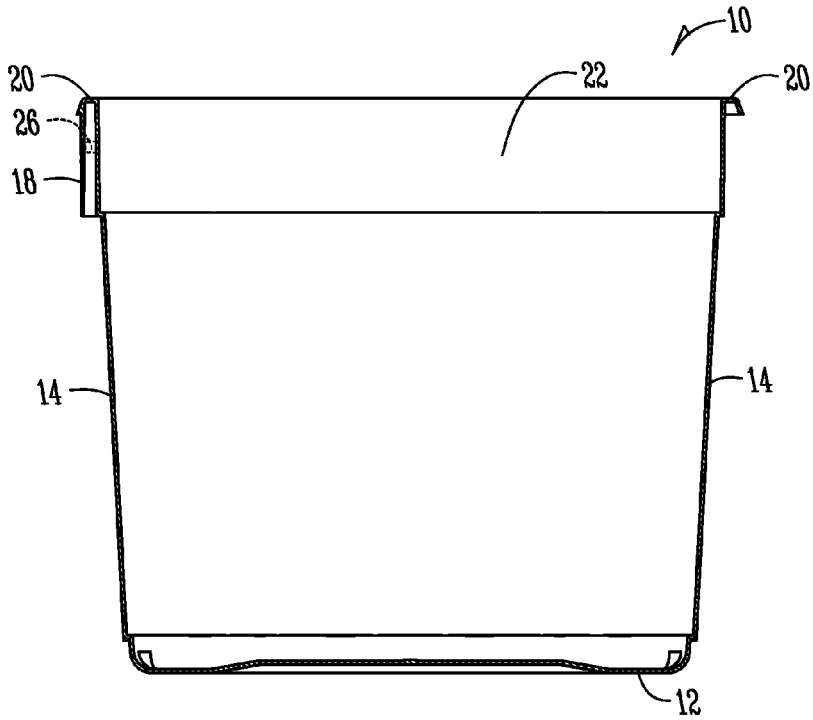
FIG. 5 is a cross-sectional view of the container taken along line 5-5 in FIG. 3.
Figure 6:
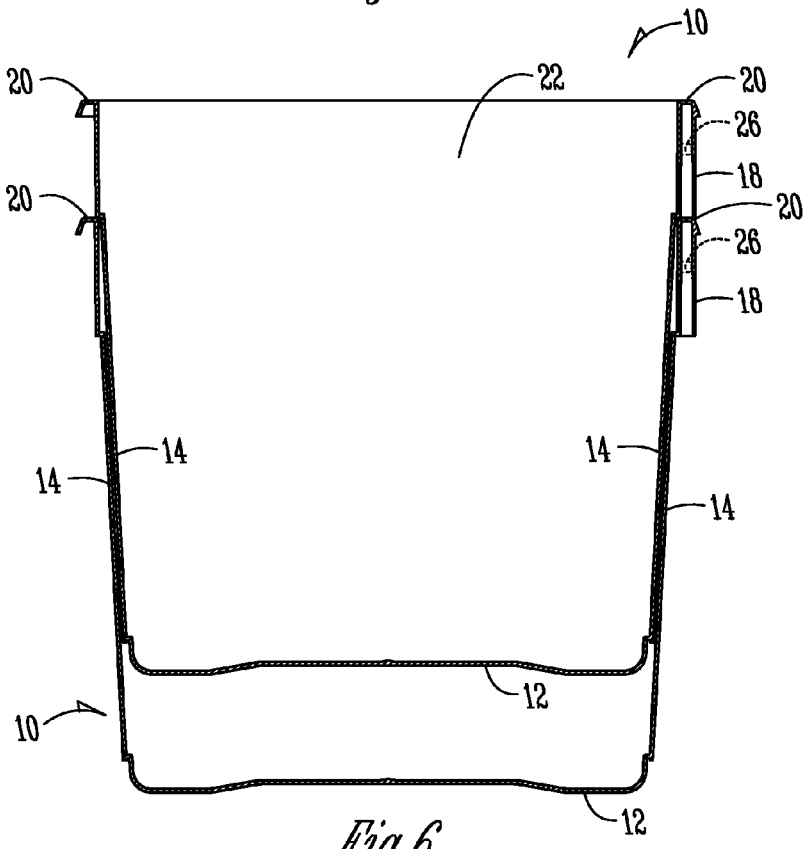
FIG. 6 is a side cross-sectional view of one container nested or stacked with another container.

FIGS. 3-6 show various views of one embodiment of the container 10. It is noted, however, that the container is not shown with the bail 24 attached as shown in FIGS. 1 and 2. However, the bail 24 can attach to the container as described above or any other desirable way. According to one aspect of the container 10, the container 10 is formed having a base 12 with sidewalls 14 extending upward from the base 12 terminating in a mouth 22. The sidewalls 14 are connected together by a corner 16 that may be radiused (viewing the container 10 from the outside) or chamfered (viewing the container 10 from the inside). The sidewalls 14 may also connect to form a corner 16 that is square, filleted, or otherwise. The mouth 22 of the container 10 has a lip 20 as best illustrated in FIGS. 4 and 5. The lip 20 is adapted to mate with a corresponding slot 40 in lid 30 for sealing the lid 30 to the container 10 as best shown in FIGS. 8-11 and 13. Ears 18 are fashioned into opposite corners 16 near the mouth 22 of the container 10 for holding the bail 24. FIG. 5 illustrates how one container 10 may be staked or nested inside another container 10 for ease in shipping and storing.

Figure 7:
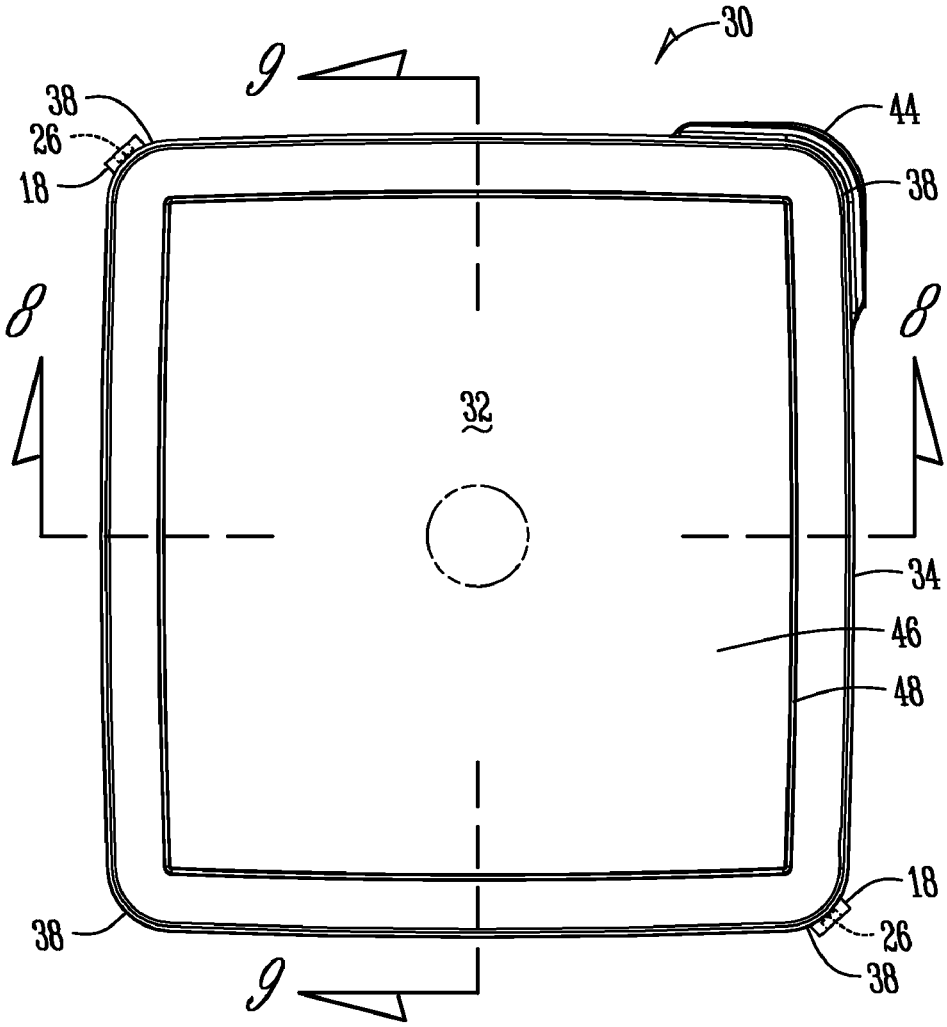
FIG. 7 is a plan view of one embodiment of the lid superimposed on the container and having a tab for removing the lid from the container.
Figure 8:
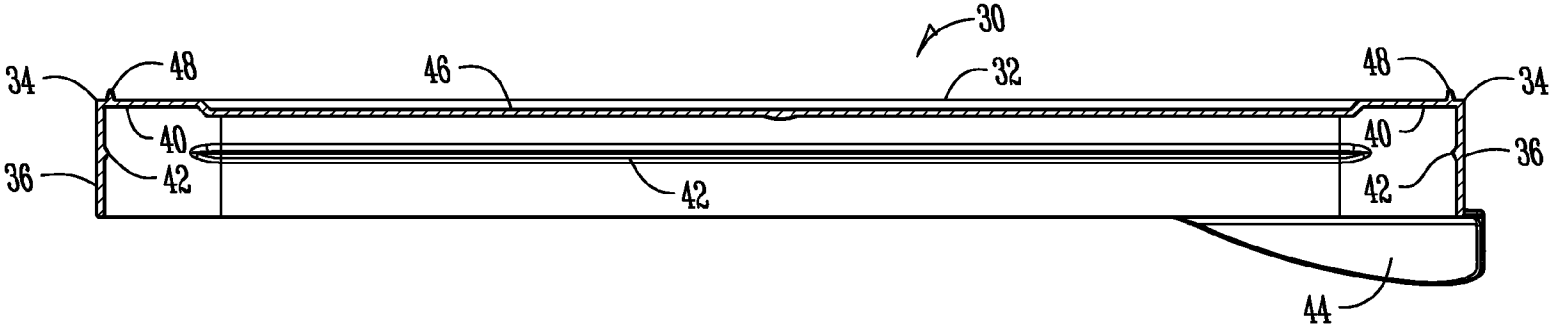
FIG. 8 is a cross-sectional view of the lid taken along line 8-8 in FIG. 7.
Figure 9:
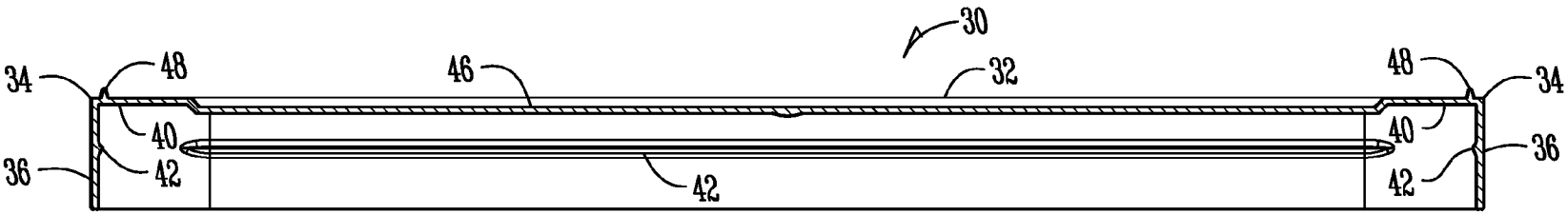
FIG. 9 is a cross-sectional view of the lid taken along line 9-9 in FIG. 7.
Figure 10:
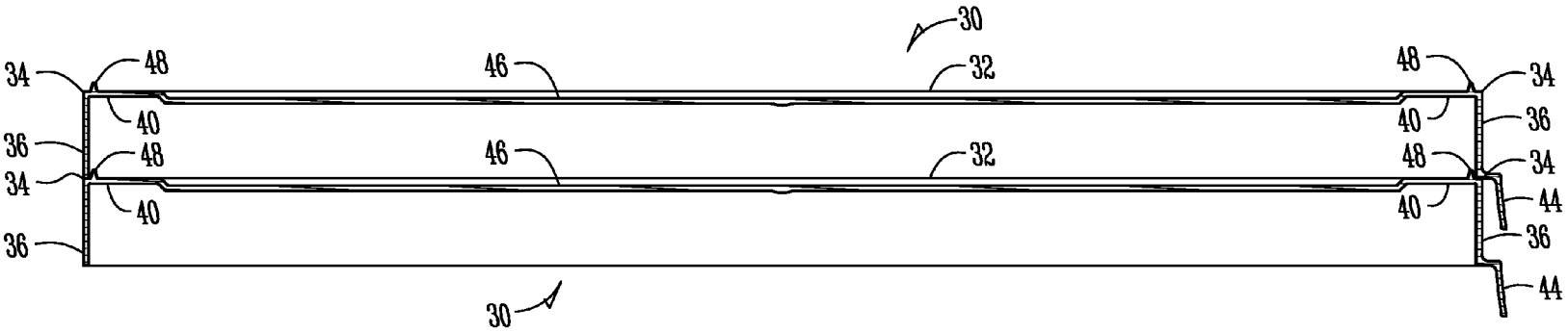
FIG. 10 is a cross-sectional view of one lid stacked or nested on top of another lid.
Figure 17:
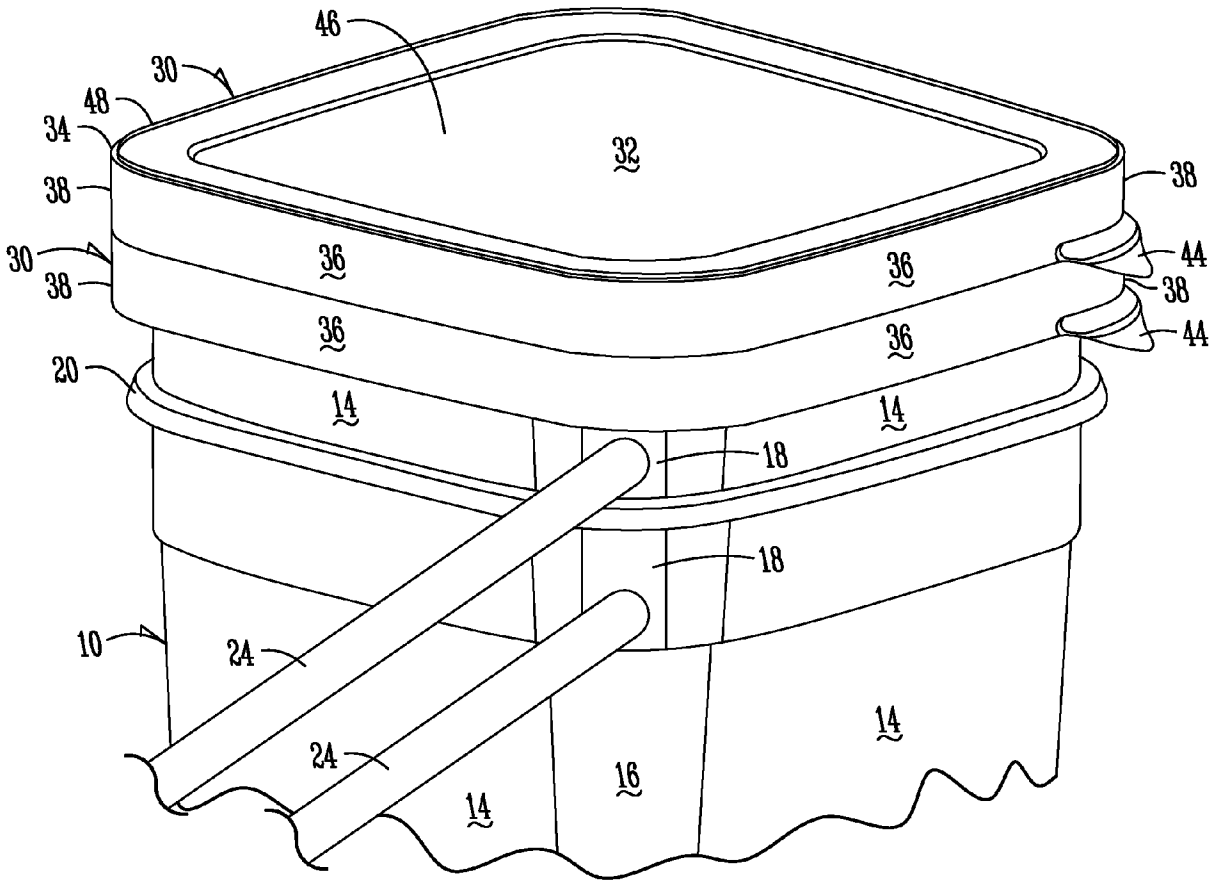
FIG. 17 is a perspective view of two lids stacked on top of one another where the bottom lid is placed upon the top of one of two stacked containers showing the bail.

FIGS. 7-11 show various views of one embodiment of the lid 30 adapted to mate with container 10. FIG. 7 shows lid 30 superimposed over container 10, where container 10 has ears 18 sticking outward on opposite corners 16 of the lid 30, with tab 44 fashioned into lid 30 on a corner 38 between ears 18 on the container 10. FIGS. 8 and 9 shows the lid 30 having a top 32 terminating in an outer periphery 34. Sides 36 extend away from the top 32 in a generally perpendicular direction. Tab 44 is configured to extend downward and outward from sides 36 of lid 30. Thus, tab 44 extends away from container 10 creating a gap between the corner 16 of the container 10 and tab 44 whereby the user may easily put their fingers under the tab 44 and pull outward and upward to separate the lid 30 from the container 10. The user may position the bail 24 on the corner 16 of the container 10 commensurate with the corner 38 of the lid 30 having the tab 44. In this manner, the user may offset or balance the torque/moment exerted on the tab 44 with the torque/moment exerted on the bail 24 making it much easier to remove the lid 30 by lifting on tab 44 while pressing down on the bail 24 against the container 10. The bail 24 and tab 44 provide surfaces that are easily gripped. For example, if the container 10 is used to hold ice cream, the outside of the container 10 may be difficult to grip, restrain or hold in position as a result of condensation and the temperature of the container 10. Thus, the bail 24 and tab 44 provide surfaces for gripping that are not so intimately associated with the container 10, making lid 30 removal easier. FIG. 10 illustrates how one lid 30 may be stacked or nested on top of another lid 30. Extending upward in a generally perpendicular direction away from top 32 of lid 30 is rim 46. Rim 46, as additionally illustrated in FIGS. 12, 14, 16 and 17, is spaced inward from the outer periphery 34 of lid 30 at a distance at least the side 36 thickness of lid 30 to help secure lids 30 when stacked together as shown in FIGS. 10 and 17. FIG. 11 illustrates how one container 10 may be staked or nested on top of another container 10 for ease in stocking, storing and shipping. In particular, base 12 of container 10 on top is shaped to fit within recess 46 in lid 30 of bottom container 10.

FIGS. 12-16 show perspective views of the lid 30 and its corresponding tab 44 according to an exemplary embodiment of the present invention. Inside the lid 30 on one of more of the sides 36 are one or more raised ridges 42 extending inward in a generally perpendicular direction from sides 36 so that the ridges 42 interfere with a lip 20 extending outward on the mouth 22 of container 10 to provide a positive seal or friction fit between the lid 30 and the container 10. Additionally, the lid 30 and the container 10 have surfaces which may contain product labels or other indicia (not shown). Applied labels, mold in place labels, or other types of labels or indicia may be used on container 10 and lid 30.

FIG. 17 shows two empty containers 10 nested within one another having a bail 24 hanging downward at an angle, such as when a user pulls the bail 24 downward toward the corner 16 of the container 10. Additionally, FIG. 17 shows two lids 30 nested on top of one another. As shown, the lid 30 easily mates with and frictionally fits with lip 20 on the mouth 22 of container 10 for sealing product inside the container 10.

It is easily understood how advantages of the present invention allow for a more efficient storage of goods and containers because of the square size of the container 10 which stack closer together leaving less wasted space outside and between the containers 10. However, square containers generally are somewhat difficult to open because of the square lids. Thus, the present invention solves these problems by providing a square-shaped container 10 with an easy-open lid 30 and a bail 24 on the container 10 to aid in opening the lid 30. Other useful and nonobvious benefits of the present invention will be apparent to those skilled in the art and the following claims.

Another advantage of the present design is that square containers which have bails generally have the bails attached to a side portion rather than a corner. This allows the bail to be approximately centered to the center of gravity for the container allowing for easy carry of the container when product is in the container. However, when bails are placed on opposite sides of the container rather than on opposite corners of the container, one cannot easily open a square lid because, as discussed above, square lids generally need to be pulled from a corner, rather than a side to open easily. The shape, radius of corners, and size of the container may vary depending on desired use of the container.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. An improved container and lid combination comprising:

a generally square container body having a base and generally planar sidewalls extending upward from the base terminating in a mouth having a lip with a first portion extending outward perpendicular to the mouth and a second portion extending downwardly and outwardly from the first portion terminating in a free, bottom edge;

a bail having an apex with opposing legs in proximity and parallel to the sidewall when the bail is horizontal, the legs pivotally attached to opposite corners of the container;

a generally square lid body having a top and planar sides extending downward from the top with opposing sides being parallel to form the lid, wherein the lid is adapted to mate to the container;

a rib extending generally inward and perpendicular from an interior surface of the sides of the lid body;

a tab which extends outward and downward from a corner portion of the lid whereby a user may pull downward on the bail and lift upward on the tab to separate the lid from the container; and the rib terminating generally at the corner portion of the lid to prevent interference between the corner portion of the lid with the lip on the mouth of the container during lid removal.

2. The improved container and lid combination of claim 1 wherein the container further comprises an ear on opposite corners having a slot adapted to pivotally secure the legs of the bail to the container.

3. The improved container and lid combination of claim 2 wherein the legs of the bail have terminal ends with a pin extending perpendicularly inward there from being securable within the slot.

4. The improved container and lid combination of claim 1 wherein the first portion of the lip of the container seats against a slot in the lid.

5. The improved container and lid combination of claim 4 wherein the rib extends between and terminates at the corner portions along each side of the lid to secure the lid to the lip of the container.

6. The improved container and lid combination of claim 1 wherein the top of the lid further comprises a recess adapted to receive the base of another container when one or more of the containers are stacked together.

7. The improved container and lid combination of claim 1 wherein the lid further comprises a rim near the outer periphery.

8. The improved container and lid combination of claim 7 wherein the rim is adapted to secure sides of another lid when one or more lids are stacked together.

9. A square-shaped lid and container combination comprising:

a container body for holding product;

a mouth of the container body having a lip with a first portion extending outward perpendicular to the mouth and a second portion extending downwardly and outwardly from the first portion terminating in a free, bottom edge;

the lid mateably and removably attached by the free, bottom edge of the container body;

a bail having an apex with opposing legs in proximity and parallel to the lid when the bail is horizontal, the legs pivotally attached to opposite corners of the container body; and a tab integrally formed in a corner of the lid, outwardly and downwardly in spaced relation to the container body.

10. The square-shaped lid and container combination of claim 9 wherein the tab includes a horizontal portion extending along the adjoining sides of the lid perpendicular to the adjoining sides to extend outward, and a vertical attached to the horizontal portion so as to extend downward from the corner generally perpendicular to the horizontal portion.

11. The square-shaped lid and container combination of claim 9 wherein the bail has an opening position at a corner of the container body commensurate with the corner portion of the lid having the tab whereby the user may a. offset a substantially vertical force applied outside a peripheral boundary defined by the sides of the lid to the tab; with b. a substantially opposite vertical force simultaneously applied within the peripheral boundary defined by the sides of the lid to the bail to easily remove the lid.

12. A method for an improved container and lid combination comprising:

taking the container having a base and sidewalls;

providing a lid having a top and sides connected together to form an outer peripheral boundary and terminating in a free, bottom edge;

gripping a bail having an apex with opposing legs in proximity and parallel to the sidewall when the bail is horizontal, the legs pivotally attached to opposite corners of the container;

applying a generally vertical force outside the peripheral boundary of the lid and container to a tab connected to a corner of the lid and having a horizontal portion extending perpendicularly outward from the bottom edge to create space behind a generally vertical portion extending downward perpendicular to the horizontal portion and a corner portion of the container; and removing the lid from the container by simultaneously applying a generally vertical force within the peripheral boundary defined by the sides of the lid against the bail.

13. The method of claim 12 further comprising the step of inserting one or more fingers generally into the space behind the vertical portion of the tab for lifting up on the tab to remove the lid.

14. The method of claim 13 further comprising the step rotating the bail to a corner of the container aligned with the tab for balancing forces exerted while removing the lid by pushing downward on the bail against the container and lifting upward on the tab at the same time.

15. A method for a square-shaped lid and container combination comprising:

providing a generally square container body having a base and upwardly extending generally planar sidewalls terminating in a skirt portion having a vertical, outer peripheral surface offset over the sidewalls, the skirt portion terminating in a mouth having a lip with a first portion extending outward perpendicular to the mouth and a second portion extending downwardly and outwardly from the first portion terminating in a free, bottom edge;

taking a lid with planar lid sidewalls connected by lid corners, the lid mateably and removably attached to the free, lower edge of the lip of the container by a rib extending generally perpendicularly inward from an interior surface of the lid sidewalls, the rib extending along the length of the interior surface of the sidewall and terminating generally before the lid corners;

rotating a bail to a corner of the container aligned with a tab, the bail having an apex with opposing legs in proximity and parallel to the skirt portion when the bail is horizontal;

gripping a tab connected to the free, lower edge of the lid, the tab having a horizontal portion extending perpendicularly outward from the lower edge to create space behind a generally vertical portion extending downward perpendicular to the horizontal portion;

pushing the bail downward against the container; and lifting upward on the tab to separate the ribs on the adjoining sidewalls of the lid commensurate with the tab from the free, bottom edge of the lip on the mouth of the container to remove the lid.

16. The method of claim 15 further comprising the step of aligning the bail on a side of the container commensurate with the side of the lid having the tab to balance forces exerted while removing the lid.

17. The method of claim 15 further comprising the step of securing a slot in the lid to the first portion of the lip on the mouth of the container using the ribs in the lid.

18. The method of claim 15 further comprising the step of stacking one or more lids together using a rim running along an outer periphery of the lid.

19. The method of claim 15 further comprising the step of inserting one or more fingers between the tab and container for gripping the tab and removing the lid.

20. An improved container and lid combination comprising:

a generally square container body having a base and upwardly extending sidewalls terminating in a skirt portion having a vertical, outer peripheral surface offset over the sidewalls;

the skirt portion terminating in a mouth having a lip with a first portion extending outward perpendicular to the mouth and a second portion extending downwardly and outwardly from the first portion terminating in a free, bottom edge;

a bail attachment at opposite corners on the skirt portion having an outer surface contour commensurate with a corner of the skirt portion, and a slot in the outer surface adapted to removably and pivotally secure a bail to the container body;

the bail having an apex with opposing legs in proximity and parallel to the skirt portion when the bail is horizontal, the legs having terminal ends with a pin extending perpendicularly inward adapted to removably and pivotally secure within the slot;

a generally square lid body having a top and downwardly extending planar sides terminating in a free, lower edge; and a lift tab attached at a corner of the lower edge of the lid body, the tab having a horizontal portion perpendicular to the sides of the lid to extend outward and a generally vertical portion parallel to the sides of the lid to extend downward in spaced relation to the container body to provide a gap for a user to insert one or more fingers for gripping to pull upward on the tab and downward on the bail to remove the lid.

* * * * *

UNITED STATES PATENT AND TRADEMARK OFFICE

CERTIFICATE OF CORRECTION

PATENT NO. : 8,006,863 B2
APPLICATION NO. : 11/845542
DATED : August 30, 2011
INVENTOR(S) : David D. Albrecht It is certified that error appears in the above-identified patent and that said Letters Patent is hereby corrected as shown below:

Col. 6, Line 23, Claim 10:
DELETE after and: "a vertical attached"
ADD after and: --a vertical portion attached--

Signed and Sealed this
Eighteenth Day of October, 2011

David J. Kappos

David J. Kappos
*Director of the United States Patent and Trademark Office*